United States Patent [19]

Collonia

[11] Patent Number: 4,569,320

[45] Date of Patent: Feb. 11, 1986

[54] DEVICE FOR REDUCING LONGITUDINAL DYNAMIC INSTABILITIES OF VEHICLES

[75] Inventor: Harald Collonia, Beselich, Fed. Rep. of Germany

[73] Assignee: VDO Adolf Schindling AG, Frankfurt am Main, Fed. Rep. of Germany

[21] Appl. No.: 701,905

[22] Filed: Feb. 15, 1985

[30] Foreign Application Priority Data

Mar. 3, 1984 [DE] Fed. Rep. of Germany ..... 3408002

[51] Int. Cl.[4] ..... F02D 9/08

[52] U.S. Cl. ..... 123/399; 123/352; 180/178

[58] Field of Search ..... 123/399, 352; 180/178, 180/179

[56] References Cited

U.S. PATENT DOCUMENTS 4,278,059 7/1981 Collonia ..... 123/399
4,471,735 9/1984 Collonia ..... 123/352
4,506,642 3/1985 Pfalzgraf ..... 123/399
4,515,126 5/1985 Kessler ..... 123/399

*Primary Examiner*—Ronald B. Cox
*Attorney, Agent, or Firm*—Martin A. Farber

[57] ABSTRACT

A device for reducing longitudinal dynamic instabilities of vehicles, in particular back and forth movements of cargo (load) and the uncontrolled periodic feeding of gas having, for the purpose of damping, a differentiation device (8) which differentiates an electric signal of the engine speed of rotation, preferably a voltage. The output signal of the differentiation device feeds a limiter-amplifier (9), the output signal of which, in its turn, intervenes in the deflection of a setting device (4) which acts on the fuel-air mixture of the engine. With this device, a deflection of the setting device takes place which counteracts periodic disturbing changes in speed of rotation while, upon an intended change in position of the setting device by the gas pedal, no perceptible additional effect is exerted on the setting member.

5 Claims, 1 Drawing Figure

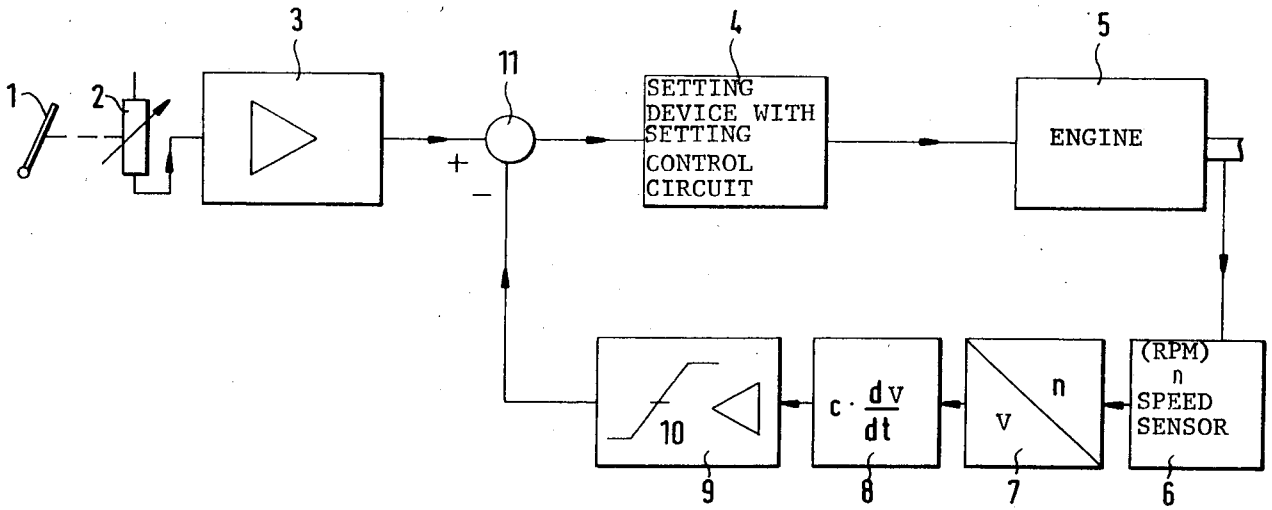
1
2
3
+
−
11
SETTING DEVICE WITH SETTING CONTROL CIRCUIT
4
ENGINE
5
10
9
c · dv/dt
8
n
v
7
(RPM) n SPEED SENSOR
6

DEVICE FOR REDUCING LONGITUDINAL DYNAMIC INSTABILITIES OF VEHICLES

BACKGROUND OF THE INVENTION

The invention relates to a device for reducing longitudinal dynamic instabilities of vehicles, in particular back and forth movements of cargo and the uncontrolled periodic feeding of gas, having means to adjust the deflection (movement) of a setting device for the fuel-air mixture which is to be fed to an internal combustion engine of the vehicle.

The longitudinal dynamic instabilities of the vehicle express themselves in the manner that upon intentional acceleration by depression of the gas pedal, undesired periodic changes in acceleration are also brought about. The accelerations are transmitted to the driver, who thus brings about an undesired change in the position of the gas pedal. The entire oscillating system, which the vehicle comprises with its elasticities in the drive train, masses to be accelerated and moments of inertia, as well as the power output of the internal combustion engine which corresponds to the operating point on the torque/speed-of-rotation curve and other factors, can be dynamically unstable. In this way an oscillation can build up with which, in the extreme case, almost the entire path of displacement of the gas pedal is unintentionally moved over (bonanza effect).

In order to remedy this undesired phenomenon which occurs, in particular, in the case of internal combustion engines having a steep torque/speed-of-rotation curve, it has already been attempted to dampen the longitudinal oscillations of the vehicle/driver system by connecting the gas pedal via a delay member to the setting member which controls the fuel/air mixture of the internal combustion engine. The delay member has been developed in particular as a dashpot. This type of damping has the drawback that even those displacements of the gas pedal which are intended by the driver are also converted only with delay into corresponding positions of the setting member. As a result of this damping device in the connection between the gas pedal and the setting device, an undesired delay thus takes place in the response of the internal combustion engine. In addition, there are difficulties in tuning the damping device since the periodic oscillation which is to be damped in the connection between the gas pedal and the engine is dependent on the type of vehicle and—for a given type of vehicle—on the gear in which it is traveling. Furthermore, this known method for apparently improving the longitudinal stability of the vehicle is basically ineffective when the disturbing excitations of the oscillations are not introduced via the gas pedal but at other places, for instance by shifting or clutching operations or irregularities in the roadbed.

It is an object of the invention to create a device which effectively reduces the injurious effects of the longitudinal dynamic instabilities of the vehicle regardless of the point of action of the disturbing influences, the parameters of which device can be adjusted in a non-critical manner and which does not perceptibly impair the response of the internal combustion engine to intended actuation of the gas pedal.

SUMMARY OF THE INVENTION

According to the invention, there are provided, as means for the deflection, a differentiation device (8) which differentiates an electric signal of the engine speed of rotation (rpm), preferably a voltage, and a limiter-amplifier (9) which is connected to the output of the differentiation device and the output signal of which intervenes in the deflection of the setting device (4).

This solution is based on the principle that a suitable signal, which is derived from the speed of rotation of the engine, is returned to the setting device for the fuel/air mixture for adjustment to a minimum jerk. For this purpose, the changes in speed of rotation of the engine are detected, and if they are recognized to be disturbing, i.e. not intentionally brought about by the driver, they are converted into oppositely directed changes in position of the setting device. Intentional movements of the gas pedal by the driver are, however, not damped by the arrangement. In particular, this damping of the longitudinal dynamic instabilities of the vehicle is effected by electrical means in the manner that an electric voltage is derived from the speed of rotation of the engine, which voltage is then differentiated and transmitted via a limiter-amplifier.

Further according to the invention, the action of this limiter-amplifier is, preferably, limited to about 50% of the working region of the deflection of the setting device. In this way, a reliable compensation for disturbing oscillations is assured while, on the other hand, the compensation does not have a detrimental effect on intentional accelerating and decelerating measures effected by the driver.

This arrangement can be combined to particular advantage with an ordinary device for the electrical deflection of the setting member by the gas pedal. In this case the coupling of the signal given off by the limiter-amplifier may be effected advisedly at the output of the device for the electrical deflection of the setting device by the gas pedal ("electric gas pedal"). In the case of this combination, the additional expense for the device for reducing the disturbing effects of longitudinal dynamic instabilities of the vehicle is particularly low, since the deflection of the setting device is effected by electromechanical means.

BRIEF DESCRIPTION OF THE DRAWING

With the above and other objects and advantages in view, the present invention will become more clearly understood in connection with the detailed description of a preferred embodiment, when considered with the accompanying drawing, of which the only figure is a signal flow diagram of the device in combination with an electric gas device.

DETAILED DESCRIPTION OF THE PREFERRED EMBODIMENT

FIG. 1 shows a gas pedal 1, the position of which is converted by an electric position transmitter 2 into an electric position signal. This signal is amplified by an amplifier 3 and converted into a corresponding position of an electromechanical setting device 4, which determines the fuel/air mixture of an internal combustion engine 5.

To this common form of electric gas device there is coupled the following device for reducing longitudinal dynamic instabilities of the vehicle.

A speed of rotation (rpm) sensor 6 which supplies an electric speed-of-rotation signal corresponding to the speed of rotation of the engine is connected to a rotatable element of the engine. This speed-of-rotation signal is converted into a proportional voltage in a speed-of-rotation/voltage converter 7. This voltage is differentiated in a differentiation device 8, which can be formed as an ordinary resistor/capacitor circuit, and is fed to a limiter-amplifier 9. As shown by the graph 10 contained in the limiter-amplifier box 9 in the drawing, the amplifier amplifies approximately linearly as long as its output voltage does not exceed a predetermined voltage range. Above this range the amplifier, however, no longer amplifies, its output voltage being maintained constant at a maximum value. This limiter circuit can be formed with a zener diode in customary manner.

The output signal of the limiter-amplifier 9 is coupled at a coupling point 11 into the signal flow path of the electric gas device.

With this device, periodic oscillations which are due to longitudinal dynamic instabilities of the vehicle are, as has been shown, practically completely counteracted since any change in the speed of rotation of the engine immediately causes an opposite change in the position of the setting device so that the fuel/air mixture is acted on in the compensating direction.

On the other hand, upon actuation of the gas pedal 1, which is intended to produce a desired change in the speed of rotation of the engine by controlling the fuel/air mixture via the setting device, the limiter-amplifier 9 acts as a limiter so that no signal which compensates for the speed of rotation of the engine is fed via the coupling point 11 into the setting device 4. The driver therefore for all practical purposes does not note that he is driving with a device for limiting the longitudinal dynamic instabilities of the vehicle.

This device has been found particularly advantageous in combination with diesel engines which cause longitudinal dynamic instabilities of the vehicle, due to their soft suspension in the vehicle and their characteristic curve.

I claim:

1. In a system for reducing longitudinal dynamic instabilities of vehicles, in particular back and forth movements of cargo and uncontrolled repetitive application of fuel, the system having means for adjusting the deflection of a setting device for the fuel-air mixture which is to be fed to an internal combustion engine of the vehicle, the improvement wherein said system further comprises:

means responsive to the rotational speed of the engine for providing an electric signal; and wherein said deflection adjusting means comprises differentiation means for differentiating said electric signal of the engine rotational speed and a limiter-amplifier which is connected to the output of said differentiation means, said adjusting means providing a deflection of the setting device in response to an output signal of said limiter-amplifier.

2. The system according to claim 1, wherein the action of the limiter-amplifier into the deflection of the setting device is limited to about 50% of the working region of the deflection of the setting device.

3. The system according to claim 1, further comprising a gas-pedal position transmitter providing an output electric signal, said adjusting means further comprises means for combining an output signal of said limiter-amplifier with the output electric signal of said gas-pedal position transmitter.

4. The system according to claim 2, further comprising a gas-pedal position transmitter providing an output electric signal, said adjusting means further comprises means for combining an output signal of said limiter-amplifier with the output electric signal of said gas-pedal position transmitter.

5. The system according to claim 1, wherein said electric signal is a voltage.

* * * * *